US008082611B1

(12) United States Patent
Marshall

(10) Patent No.: US 8,082,611 B1
(45) Date of Patent: Dec. 27, 2011

(54) PORTABLE WASHING DEVICE

(76) Inventor: Matthew E. Marshall, Marshalltown, IA (US)

( * ) Notice: Subject to any disclaimer, the term of this patent is extended or adjusted under 35 U.S.C. 154(b) by 1145 days.

(21) Appl. No.: 11/850,280

(22) Filed: Sep. 5, 2007

(51) Int. Cl.
*A47K 1/00* (2006.01)

(52) U.S. Cl. ..... 4/625; 239/146

(58) Field of Classification Search ..... 4/625, 515–519; 239/146–150, 172
See application file for complete search history.

(56) References Cited

U.S. PATENT DOCUMENTS 3,748,009 A * 7/1973 Stone ..... 312/263
3,983,583 A 10/1976 Herman et al.
4,998,302 A * 3/1991 Silva ..... 4/516
5,182,822 A 2/1993 Cyr et al.
5,313,676 A 5/1994 Wright
5,526,539 A * 6/1996 Bower et al. ..... 4/516
5,528,776 A * 6/1996 Carmichael ..... 4/516
5,687,434 A 11/1997 Tagg
5,704,078 A 1/1998 Chandler
6,173,458 B1 * 1/2001 Maddux ..... 4/626
6,711,757 B2 * 3/2004 Peck ..... 4/516
6,848,126 B2 * 2/2005 Marcellus ..... 4/625

* cited by examiner

*Primary Examiner* — Davis Hwu
(74) *Attorney, Agent, or Firm* — Crossley Patent Law; Mark A. Crossley

(57) ABSTRACT

A portable washing device that combines a base unit, an attached reservoir unit, and a volume of water to create a mobile and easily transportable washing device. The reservoir unit is located above the base unit and includes an attached faucet assembly that allows water to flow from the reservoir unit to the base unit through a faucet after a knob on the faucet is activated. A receiving container located within the base unit catches water after it is utilized in a sink that is located atop the base unit. The receiving container can be drained at a time and place convenient for an individual.

6 Claims, 6 Drawing Sheets

PORTABLE WASHING DEVICE

BACKGROUND OF THE INVENTION

The present invention concerns that of a new and improved portable washing device that would combines a base unit, an attached reservoir unit, and a volume of water to create a mobile and easily transportable washing device.

DESCRIPTION OF THE PRIOR ART

U.S. Pat. No. 5,687,434, issued to Tagg, discloses a portable wash station that includes an outer water tank, a flexible inner water tank secured with the outer water tank, and a sink basin affixed atop the outer tank.

U.S. Pat. No. 5,704,078, issued to Chandler, discloses a portable sink particularly adapted for use in a portable toilet and includes a cabinet in which a conventional five gallon bottle of water can be retained.

U.S. Pat. No. 3,983,583, issued to Herman et al., discloses a portable wet bar having a removable top which exposes counter space beneath the top.

U.S. Pat. No. 5,182,822, issued to Cyr et al., discloses a cabinet structure which includes side walls, a floor, a rear wall, and a top wall mounting a concave sink therewithin.

U.S. Pat. No. 5,313,676, issued to Wright, discloses a sportsman's sink having foldable legs arranged to include a pump member and to receive water from available water supplies and direct such water through a faucet to an underlying sink.

SUMMARY OF THE INVENTION

The present invention concerns that of a new and improved portable washing device that would combines a base unit, an attached reservoir unit, and a volume of water to create a mobile and easily transportable washing device. The reservoir unit is located above the base unit and includes an attached faucet assembly that allows water to flow from the reservoir unit to the base unit through a faucet after a knob on the faucet is activated. A receiving container located within the base unit catches water after it is utilized in a sink that is located atop the base unit. The receiving container can be drained at a time and place convenient for an individual.

There has thus been outlined, rather broadly, the more important features of a portable washing device that the detailed description thereof that follows may be better understood and in order that the present contribution to the art may be better appreciated. There are, of course, additional features of the portable washing device that will be described hereinafter and which will form the subject matter of the claims appended hereto.

In this respect, before explaining at least one embodiment of the portable washing device in detail, it is to be understood that the portable washing device is not limited in its application to the details of construction and to the arrangements of the components set forth in the following description or illustrated in the drawings. The portable washing device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present portable washing device. It is important, therefore, that the claims be regarded as including such equivalent constructions insofar as they do not depart from the spirit and scope of the present invention.

It is therefore an object of the present invention to provide a portable washing device which has all of the advantages of the prior art and none of the disadvantages.

It is another object of the present invention to provide a portable washing device which may be easily and efficiently manufactured and marketed.

It is another object of the present invention to provide a portable washing device which is of durable and reliable construction.

It is yet another object of the present invention to provide a portable washing device which is economically affordable and available for relevant market segment of the purchasing public.

Other objects, features and advantages of the present invention will become more readily apparent from the following detailed description of the preferred embodiment when considered with the attached drawings and appended claims.

BRIEF DESCRIPTION OF THE DRAWINGS

FIG. 4 shows a side cutaway view of the portable washing device as it would appear prior to turning the faucet and spigot on.

FIG. 5 shows a side cutaway view of the portable washing device as it would appear after turning the faucet and spigot on.

DESCRIPTION OF THE PREFERRED EMBODIMENT

Figure 1:
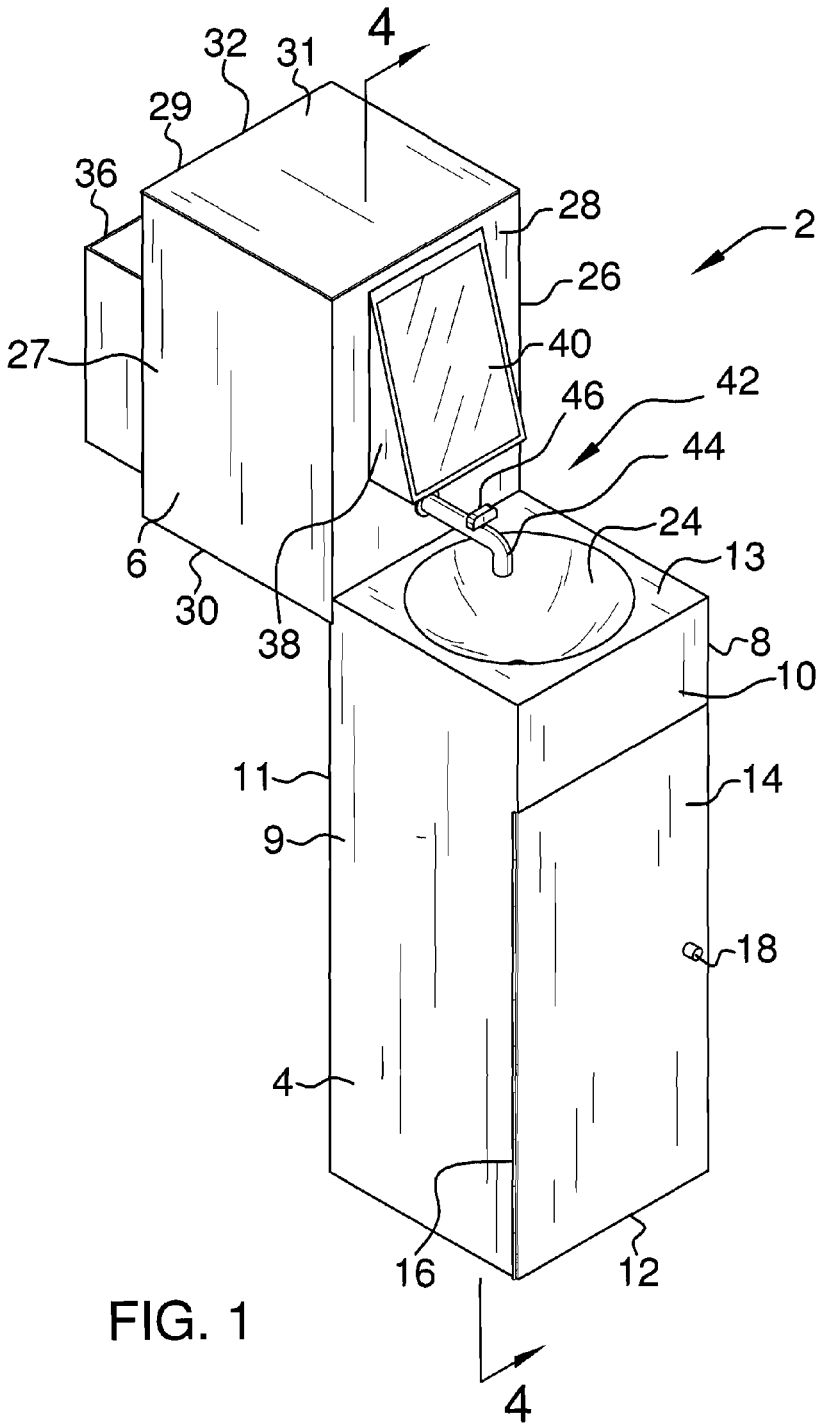
FIG. 1 shows a front perspective view of the portable washing device as it would appear in use.
Figure 2:
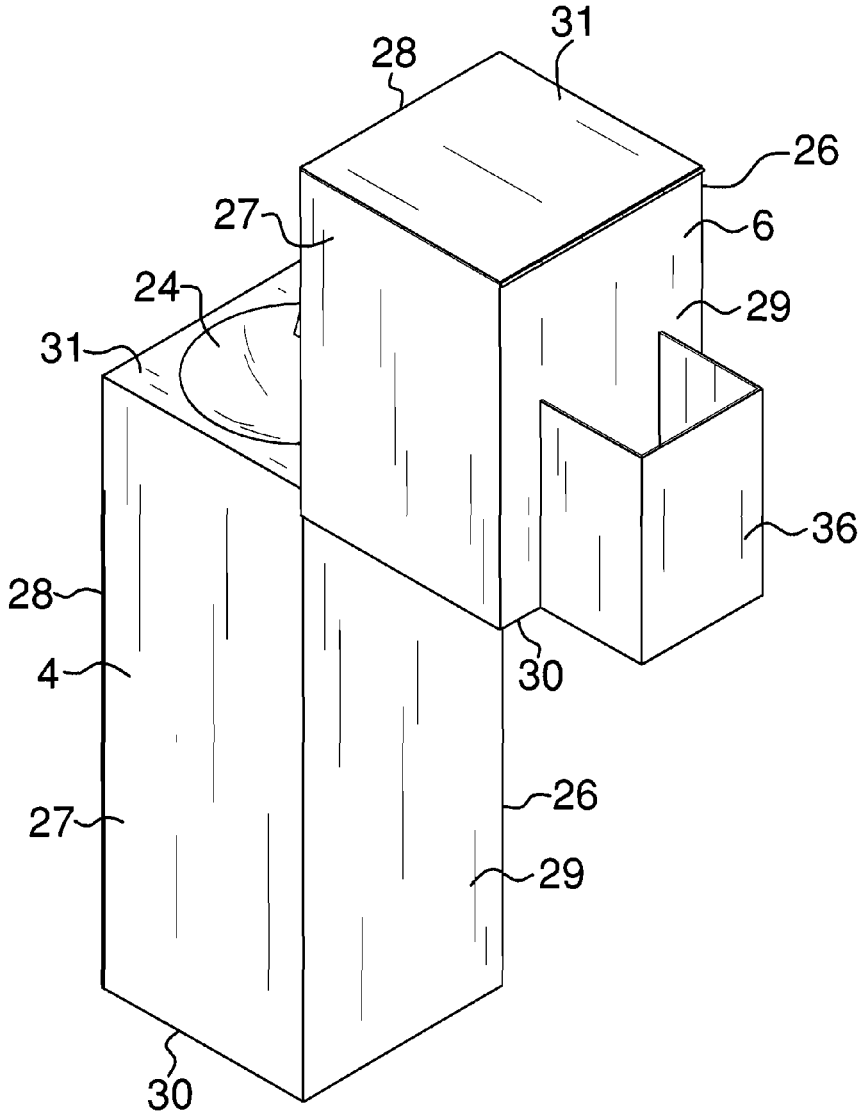
FIG. 2 shows a rear perspective view of the portable washing device as it would appear in use.
Figure 3:
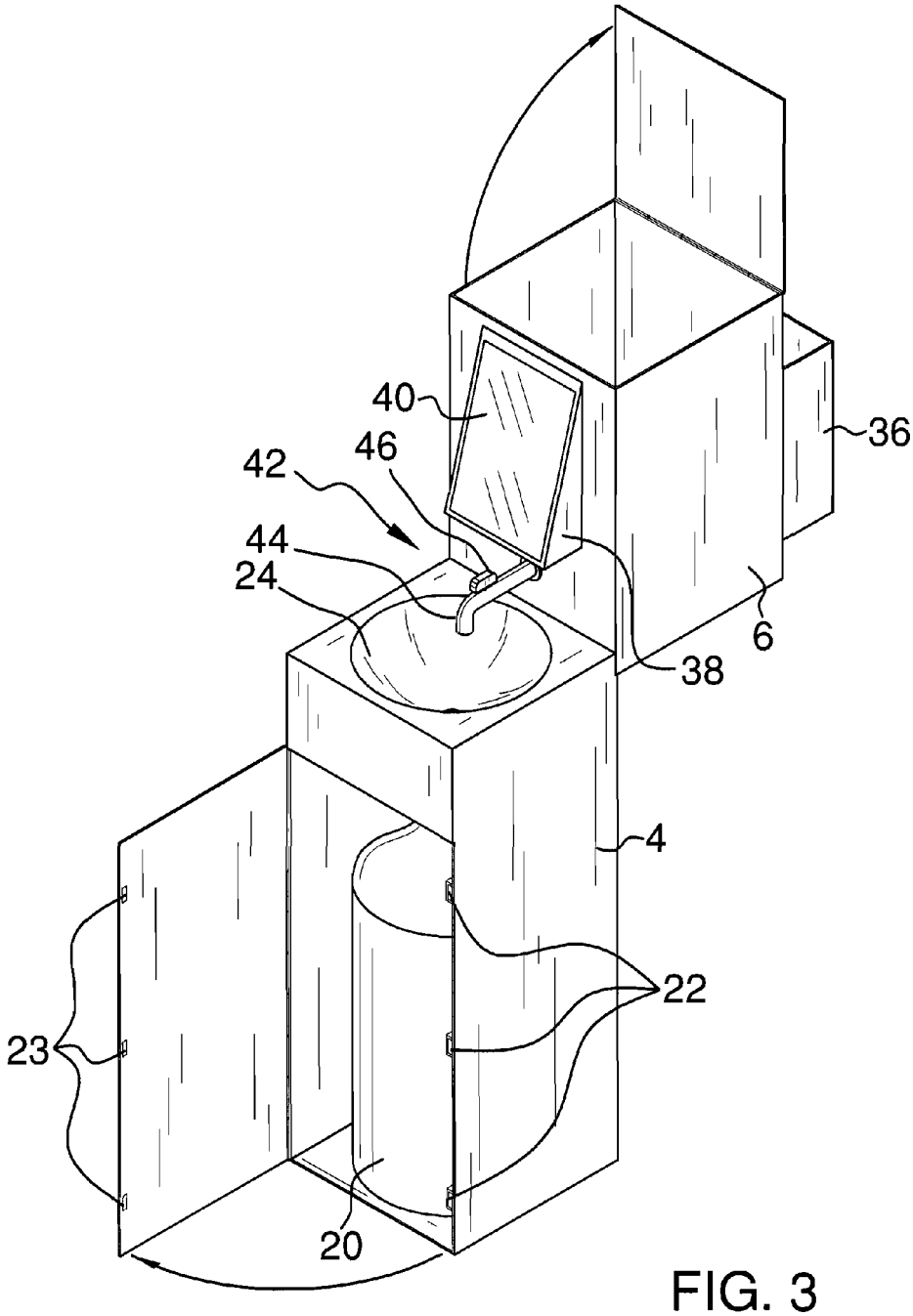
FIG. 3 shows a front perspective view of the portable washing device as it would appear in use, showing the lid on the reservoir unit and the door on the base unit open.
Figure 4:
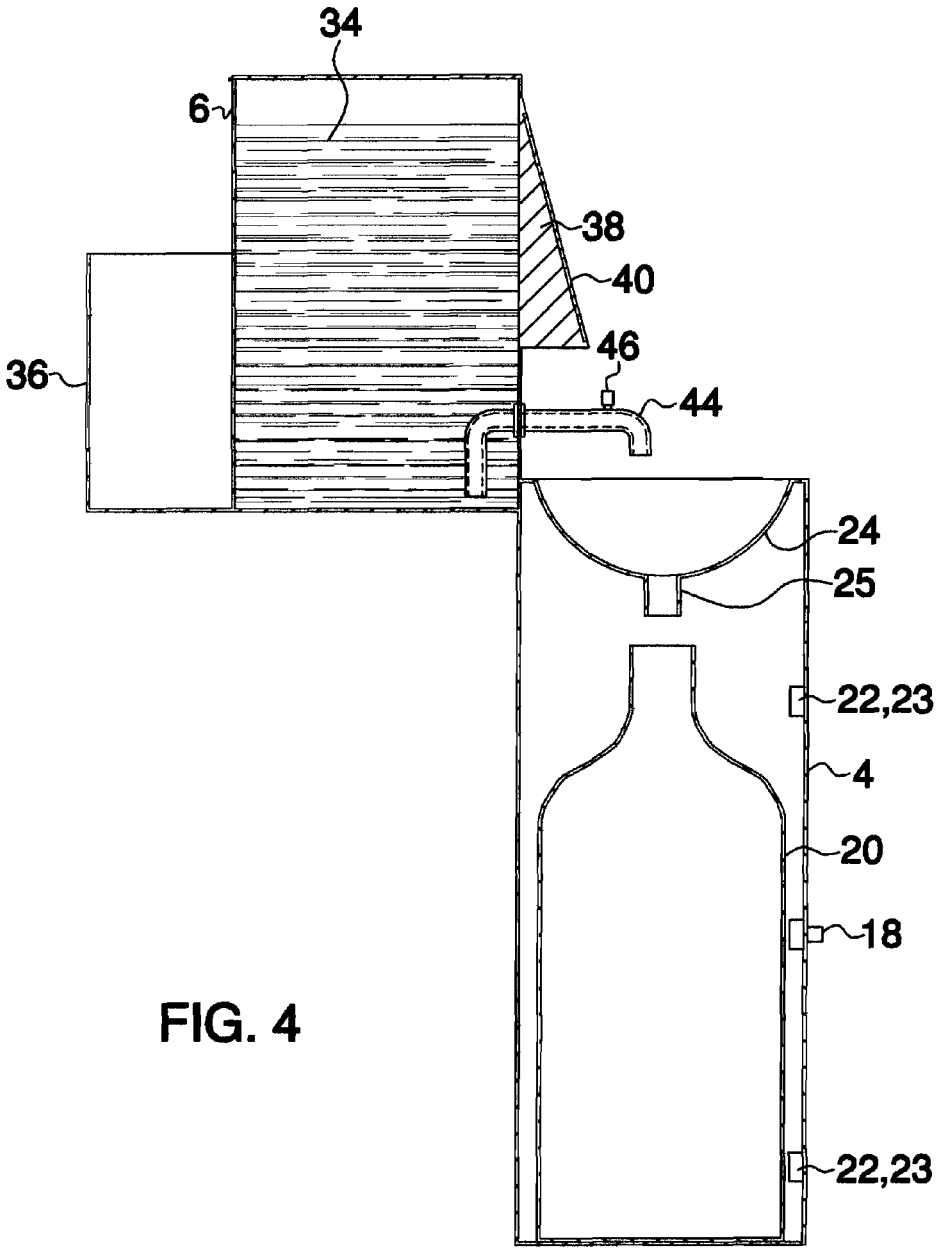
Figure 5:
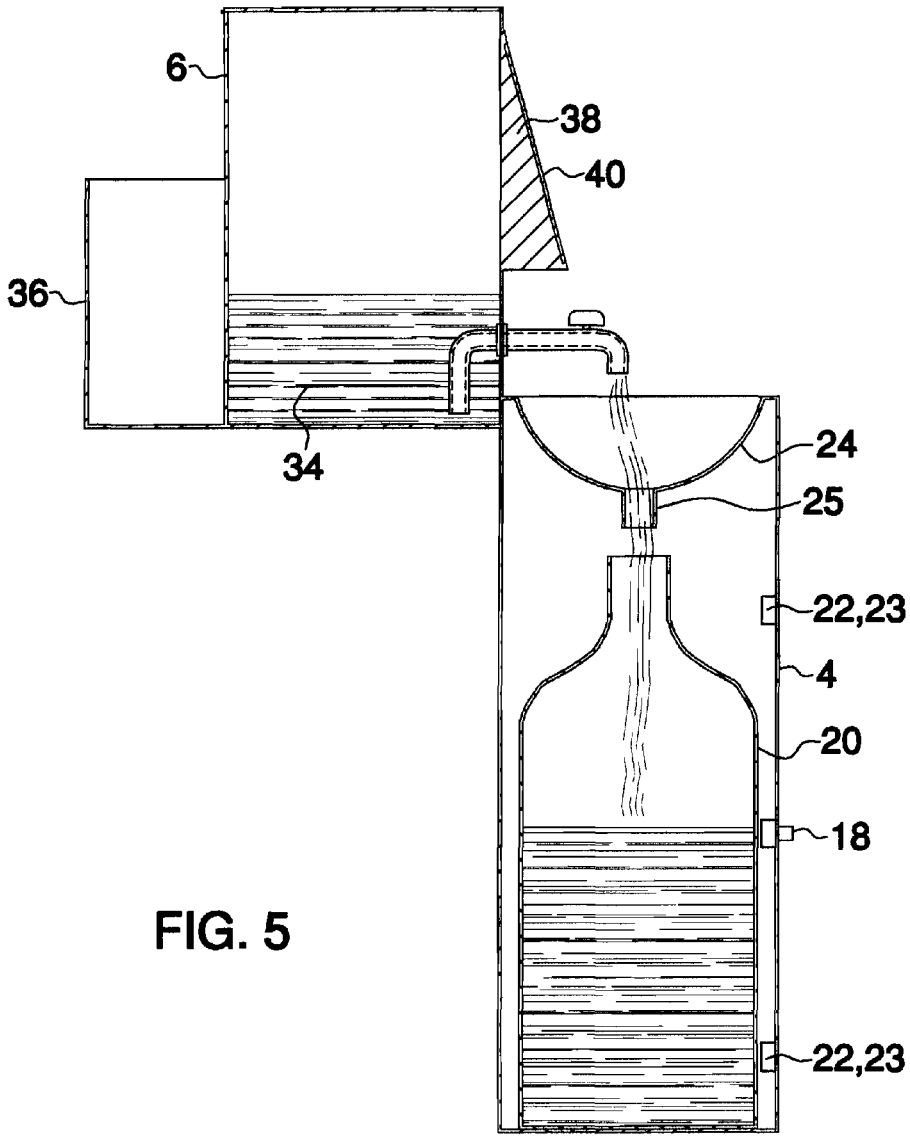
Figure 6:
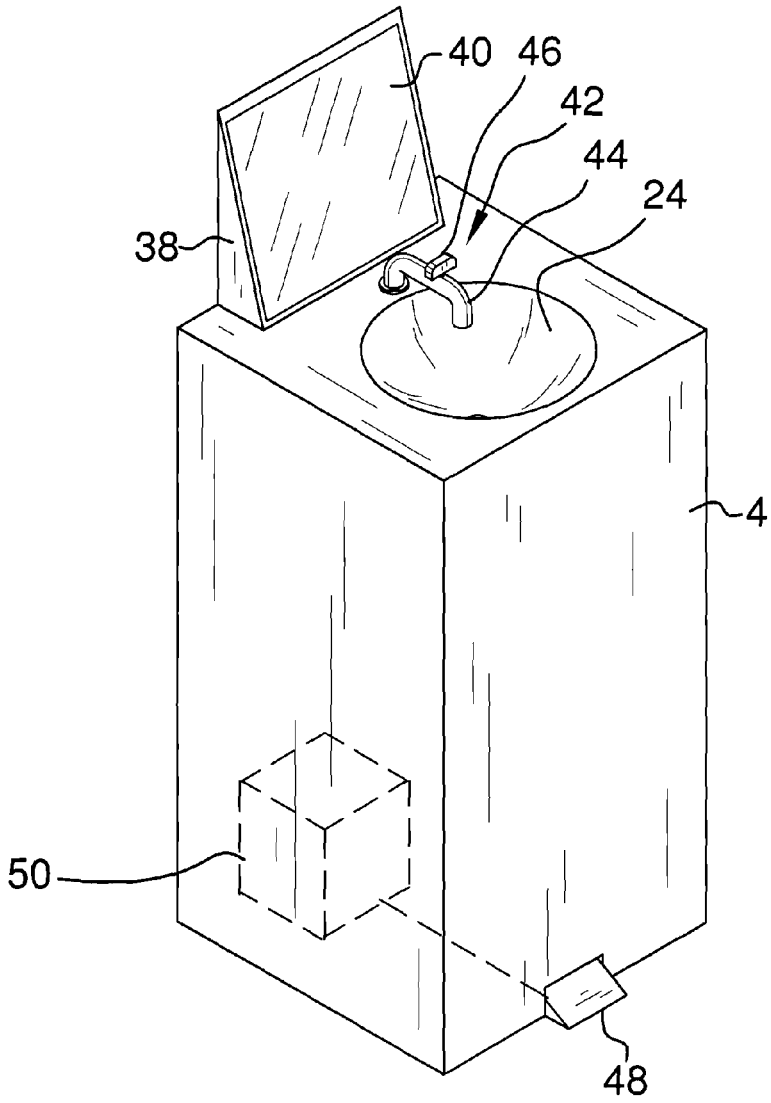
FIG. 6 shows a perspective view of an alternative embodiment of the portable washing device.

With reference now to the drawings, and in particular to FIGS. 1 through 6 thereof, a new portable washing device embodying the principles and concepts of the present invention and generally designated by the reference numeral 2 will be described.

As best illustrated in FIGS. 1 through 6, the portable washing device 2 comprises a base unit 4 and an attached reservoir unit 6. The base unit 4 is preferably rectangular in shape and has several vertical sides comprising a left side 8, a right side 9, a front side 10, and a rear side 11. The left side 8 and right side 9 are attached to the front side 10, and furthermore, are each attached to the rear side 11. Furthermore, the base unit 4 further comprises a top surface 13 and a bottom surface 12, each of which are attached to the four vertical sides 8-11.

The reservoir unit 6 is preferably rectangular in shape and has several vertical sides comprising a left side 26, a right side 27, a front side 28, and a rear side 29. The left side 26 and the right side 27 are each attached to the front side 28, and furthermore, are each attached to the rear side 29. Furthermore, the reservoir unit 6 further comprises a top surface 31 and a bottom surface 30, each of which are attached to the four vertical sides 26-29.

The base unit 4 has a base door 14 which is on the front side 10 of the base unit 10. The base door 14 is pivotally attached to the base unit 4 through a hinge 16 and can be opened via a pull knob 18 that is located on the base door 14. Within the base unit 4, a bottle 20 is located. The bottle 20 essentially collects all of the water that exits from the drain tube 25 of the sink 24, which is located on the top surface 13 of the base unit 4.

When the base door 14 is normally kept closed, magnets are used to keep the base door 14 shut. Essentially, a first plurality of magnets 22 are attached to the base unit 4 within the base unit 4, with a second plurality of magnets 23 being attached to the base door 14. When the base door 14 is shut, each magnet of the first plurality of magnets 22 is placed against a magnet of the second plurality of magnets 23, causing some attraction between each pair of such magnets. This attraction between the magnets generally helps to maintain the base door 14 in a closed position.

A portion of the front side 28 of the reservoir unit 6 near the bottom surface 30 of the reservoir unit 6 is attached to the rear side 11 of the base unit 4 near the top surface 13 of the base unit 4. Furthermore, the top surface 31 of the reservoir unit 6 is pivotally attached to the reservoir unit by hinge 32. Generally, a volume of water 34 is placed within the reservoir unit 6.

The water 34 within the reservoir unit 6 can be utilized by using the faucet assembly 42. Faucet assembly 42 comprises a faucet 44, which is partially located within the reservoir unit and partially located over the sink on the top surface 13 of the base unit 4. Furthermore, the faucet 44 of the faucet assembly 42 can personally be turned on and off through use of knob 46 that is located on top of the faucet 44.

Reservoir unit 6 further includes a holder 36 that is attached to the rear side 29 of the reservoir unit 6. The holder 36 is designed to hold such items as toiletries, towels, and related items that are typically used with sinks. Reservoir unit 6 further includes a mirror 40 that is located on the front side 28 of the reservoir unit 6. Mirror 40 is preferably mounted on a mirror support 38 that is angled in a manner that allows the lower portion of the mirror to stick out further from the front side 28 of the reservoir unit 6 than the upper portion of the mirror 40 would. This positioning allows for an individual who is taller than the portable washing device 2 to utilize the mirror without having to squat or bend down to a level that is the same as that of the portable washing device 2.

In an alternative embodiment of the present invention, the portable washing device 2 does not have a separate washing unit. Instead, the water 34 is stored within the base unit and is pumped up via pump 50 to the faucet assembly 42. The pump 50 is activated by a foot lever 48 that is located on the base unit 4.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A portable washing device comprising a base unit, the base unit comprising a plurality of vertical sides comprising (i) a left side, (ii) a right side, (iii) a front side attached to the left side and the right side, (iv) a rear side attached to the left side and the right side, (v) a top surface attached to each of the four vertical sides, and (vi) a bottom surface attached to each of the four vertical sides, a reservoir unit attached to the base unit, the reservoir unit comprising a plurality of vertical sides comprising (i) a left side, (ii) a right side, (iii) a front side attached to the left side and the right side, (iv) a rear side attached to the left side and the right side, (v) a top surface attached to each of the four vertical sides, and (vi) a bottom surface attached to each of the four vertical sides, a volume of water located within the reservoir unit, means for emitting some of the volume of water so it can be used for washing purposes, wherein the top surface of the reservoir unit is pivotally attached to the reservoir unit, a base door pivotally attached to the front side of the base unit, means for opening up the base door, means for keeping the base door closed, a sink, wherein the sink is located on the top surface of the base unit, wherein the means for opening up the base door further comprises a pull knob located on the base door, wherein the means for keeping the base door closed further comprises a first plurality of magnets attached to the base unit within the base unit, a second plurality of magnets attached to the base door, wherein each magnet of the first plurality of magnets is placed against a magnet of the second plurality of magnets when the base door is shut, causing some attraction between each magnet pairing, wherein the means for emitting some of the volume of water so it can be used for washing purposes comprises a faucet assembly, the faucet assembly further comprising a faucet, the faucet being partially located within the reservoir unit and partially located over the sink located on the top surface of the base unit, a knob located on the faucet, wherein the faucet can be turned on or turned off through the use of the knob, means for collecting water emitted from the faucet, wherein the means for collecting water emitted from the faucet further comprises a bottle located within the base unit, a drain tube attached to the sink, wherein all water that exits the sink through the drain tube is collected within the receiving container.

2. A portable washing device according to claim 1 wherein the device further comprises (a) a mirror support mounted on the front side of the reservoir unit, and (b) a mirror mounted on the mirror support.

3. A portable washing device according to claim 2 wherein the mirror is angled such that the lower portion of the mirror sticks out further from the front side of the reservoir unit than the upper portion of the mirror.

4. A portable washing device according to claim 3 wherein the device further comprises a holding container, the holding container being attached to the rear side of the reservoir unit.

5. A portable washing device comprising (a) a base unit, the base unit comprising a plurality of vertical sides comprising (i) a left side, (ii) a right side, (iii) a front side attached to the left side and the right side, (iv) a rear side attached to the left side and the right side, (v) a top surface attached to each of the four vertical sides, and (vi) a bottom surface attached to each of the four vertical sides, and (b) a reservoir unit attached to the base unit, the reservoir unit comprising a plurality of vertical sides comprising (i) a left side, (ii) a right side, (iii) a front side attached to the left side and the right side, (iv) a rear side attached to the left side and the right side, (v) a top surface attached to each of the four vertical sides, (vi) a bottom surface attached to each of the four vertical sides, (vii) wherein the top surface of the reservoir unit is pivotally attached to the reservoir unit, (c) a volume of water located within the reservoir unit, (d) means for emitting some of the volume of water so it can be used for washing purposes, said means further comprising (i) a faucet, the faucet being partially located within the reservoir unit and partially located over the sink located on the top surface of the base unit, (ii) a knob located on the faucet, (iii) wherein the faucet can be turned on or turned off through the use of the knob, (e) a base door pivotally attached to the front side of the base unit, (f) means for opening up the base door, said means further comprising a pull knob located on the base door, (g) means for keeping the base door closed, said means further comprising (i) a first plurality of magnets attached to the base unit within the base unit, (ii) a second plurality of magnets attached to the base door, and (iii) wherein each magnet of the first plurality of magnets is placed against a magnet of the second plurality of magnets when the base door is shut, causing some attraction between each magnet pairing, (h) a sink, wherein the sink is located on the top surface of the base unit, (i) a bottle located within the base unit, (ii) a drain tube attached to the sink, (iii) wherein all water that exits the sink through the drain tube is collected within the receiving container, (j) a mirror support mounted on the front side of the reservoir unit, (k) a mirror mounted on the mirror support, and (l) a holding container, the holding container being attached to the rear side of the reservoir unit.

6. A portable washing device according to claim 5 wherein the mirror is angled such that the lower portion of the mirror sticks out further from the front side of the reservoir unit than the upper portion of the mirror.

* * * * *